US007170459B1

(12) United States Patent
McKim

(10) Patent No.: US 7,170,459 B1
(45) **Date of Patent: *Jan. 30, 2007**

(54) SPLIT LEAD ANTENNA SYSTEM

(76) Inventor: Michael McKim, PMB #364, 3213 W. Wheeler St., Seattle, WA (US) 98199

( * ) Notice: Subject to any disclaimer, the term of this patent is extended or adjusted under 35 U.S.C. 154(b) by 0 days.

This patent is subject to a terminal disclaimer.

(21) Appl. No.: 10/884,176

(22) Filed: Jul. 1, 2004

Related U.S. Application Data

(63) Continuation-in-part of application No. 10/405,893, filed on Apr. 1, 2003, now Pat. No. 6,888,507.

(60) Provisional application No. 60/404,062, filed on Aug. 16, 2002, provisional application No. 60/500,928, filed on Sep. 8, 2003, provisional application No. 60/484,573, filed on Jul. 1, 2003.

(51) Int. Cl.
*H01Q 1/34* (2006.01)
*H01Q 1/12* (2006.01)

(52) U.S. Cl. ..... 343/709; 343/892; 343/878

(58) Field of Classification Search ..... 343/709, 343/878, 892, 872, 791, 792
See application file for complete search history.

(56) References Cited

U.S. PATENT DOCUMENTS 4,482,333 A 11/1984 Geri et al.
5,111,212 A * 5/1992 DeSatnick et al. ..... 343/709
5,489,911 A * 2/1996 Gordon et al. ..... 343/709
5,870,064 A * 2/1999 Kaegebein ..... 343/853
5,905,467 A 5/1999 Narayanaswamy et al.
6,057,804 A 5/2000 Kaegebein
6,384,696 B1 * 5/2002 Miller et al. ..... 333/132
6,888,507 B2 * 5/2005 McKim ..... 343/709

* cited by examiner

*Primary Examiner*—Don Wong
*Assistant Examiner*—Marie Antoinette Cabucos
(74) *Attorney, Agent, or Firm*—David H. Jaffer; Pillsbury Winthrop Shaw Pittman LLP

(57) ABSTRACT

An antenna assembly for mounting on a backstay of a sailboat. An insulative support apparatus includes a slotted center tube that can be forced over the backstay for mounting thereon. First and second outer tubes are attached on opposite sides of the center tube for holding first and second elongated radiators. Proximal ends of the radiators are electrically joined together and to a lead in-wire for connection to a receiver and/or transmitter. Distal ends of the radiators are secured at distal ends of the outer tubes by attachment to eyelets on the bottoms of plugs inserted into the distal ends of the outer tubes, which serve additionally to prevent water from entering the tubes. The outer tubes each include a water drainage channel to allow moisture accumulating to run out a bottom, proximal end of each tube.

7 Claims, 14 Drawing Sheets

38
46
44
54
58
60
56
SECTION A-A 66
72
70

90
94
98
64
38
92
96
100
42
10
A
44
46
40
A
48
58
68
62
60
66
87
84
86
82
88
80
78
76
74

52
50

41
41
L

39
L

SPLIT LEAD ANTENNA SYSTEM

This application incorporates by reference and is a continuation-in-part of U.S. patent application Ser. No. 10/405,893 filed Apr. 1, 2003 now U.S. Pat. No. 6,888,507 which claims priority from U.S. Provisional Application Ser. No. 60/404,062 filed Aug. 16, 2002, and this application claims priority from U.S. Provisional Patent Application Ser. No. 60/500,928 filed Sep. 8, 2003, and Ser. No. 60/484,573 filed Jul. 1, 2003.

BACKGROUND OF THE INVENTION

1. Field of the Invention

The present invention relates generally to antennas for receiving and/or sending electromagnetic energy, and more particularly to a split lead antenna for transmitting and receiving MF/HF radio signals aboard a vessel at sea that mounts on an electrically conductive backstay used in the support of a sailing boat mast.

2. Description of the Prior Art

A common antenna used on a sailboat includes a quarter wavelength whip mounted on top of the sailboat's mast. The antenna in such an installation is difficult to access for service. U.S. Pat. No. 5,489,911 describes a dipole antenna mounted to a sailboat mast backstay. An elongated flexible plastic extrusion has a "C" shaped first channel that is forced over the backstay. A second channel parallel to the first channel is used to insert a dipole antenna that lies parallel to the backstay. Other antenna configurations supported by, but exterior to the extrusion, are also described. French Patent 2,223,847 by Boulch describes an antenna in the form of a length of conductive tube to which a backstay is passed. Electrical insulators are used between the tube and the backstay.

Another common method of constructing an antenna is to make the antenna part of the backstay. Electrical insulators are attached at each end of the antenna length, which are then connected to additional backstay lengths to complete the required backstay length. A problem with this antenna is that the insulators are relatively fragile compared with the additional lengths, and if they break, the mast is left without backstay support.

SUMMARY

It is an object of the present invention to provide an improved antenna for mounting on a conductive backstay of a sailboat.

It is a further object of the present invention to provide a split lead antenna assembly that can be press fit onto a sailboat backstay.

It is another object of the present invention to provide a split lead antenna assembly providing parallel radiators on either side of a conductive backstay when the assembly is mounted thereon.

Briefly, an embodiment of the present invention includes an antenna assembly for mounting on a backstay of a sailboat. An insulative support apparatus is provided including a slotted center tube that can be forced over the backstay for mounting thereon. First and second outer tubes are attached parallel to and on opposite sides of the center tube for holding juxtaposed first and second elongated radiators. Proximal ends of the radiators are connected to a lead-in wire for connection to a common electrical point of a receiver and/or transmitter. Distal ends of the radiators are secured at distal ends of the outer tubes by attachment to eyelets on the bottom of plugs inserted into the distal ends of the outer tubes, with the plugs serving additionally to prevent water from entering the tubes.

IN THE DRAWING

DETAILED DESCRIPTION OF THE PREFERRED EMBODIMENT

Figure 1:
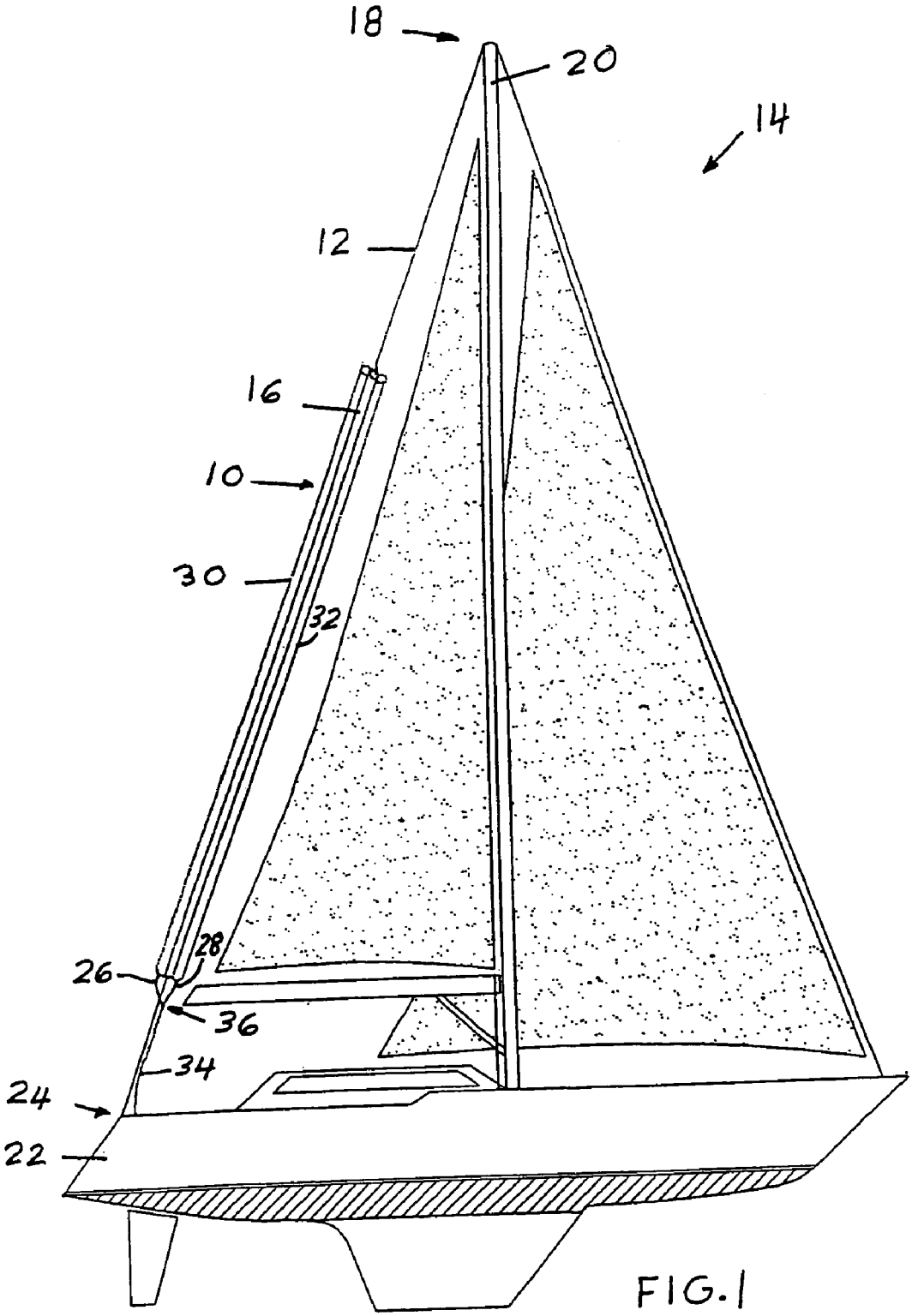
FIG. 1 illustrates the split lead antenna of the present invention mounted on a backstay of a sailboat.

FIG. 1 of the drawing illustrates a split lead antenna assembly 10 according to the present invention, installed on a conductive backstay 12 of a sailboat 14. The assembly 10 includes a three channel support apparatus 40, with an insulative center tube 16 and two outer tubes 30 and 32. The backstay 12 extends through the center tube 16 and is secured at or near the top 18 of the mast 20, and runs continuously from the point of securing 18, through the tube 16, and down to the boat body 22 to which the backstay is secured at some point illustrated symbolically as point 24. In one embodiment, a first radiator apparatus 26 is positioned in an outer tube 30, lying substantially parallel to the center tube 16. A second radiator apparatus 28 is positioned in outer tube 32, also lying parallel to the center tube 16, and spaced substantially 180° around the center tube 16 from the first radiator 26. The first and second radiator apparatus contain elements constructed of conductive material. The conductive elements of the first and second radiator apparatus are joined electrically together at a proximal end of the antenna assembly 10, and are also connected to a lead-in wire of a cable 34 at a point 36. This connection can either be permanent, or through a connector. The cable 34 is run to a transmitter and/or receiver (not shown), which for example could be in the body 22 of the sailboat 14.

Figures 2A, 2B, 2C, 2D, 2E, 2F:
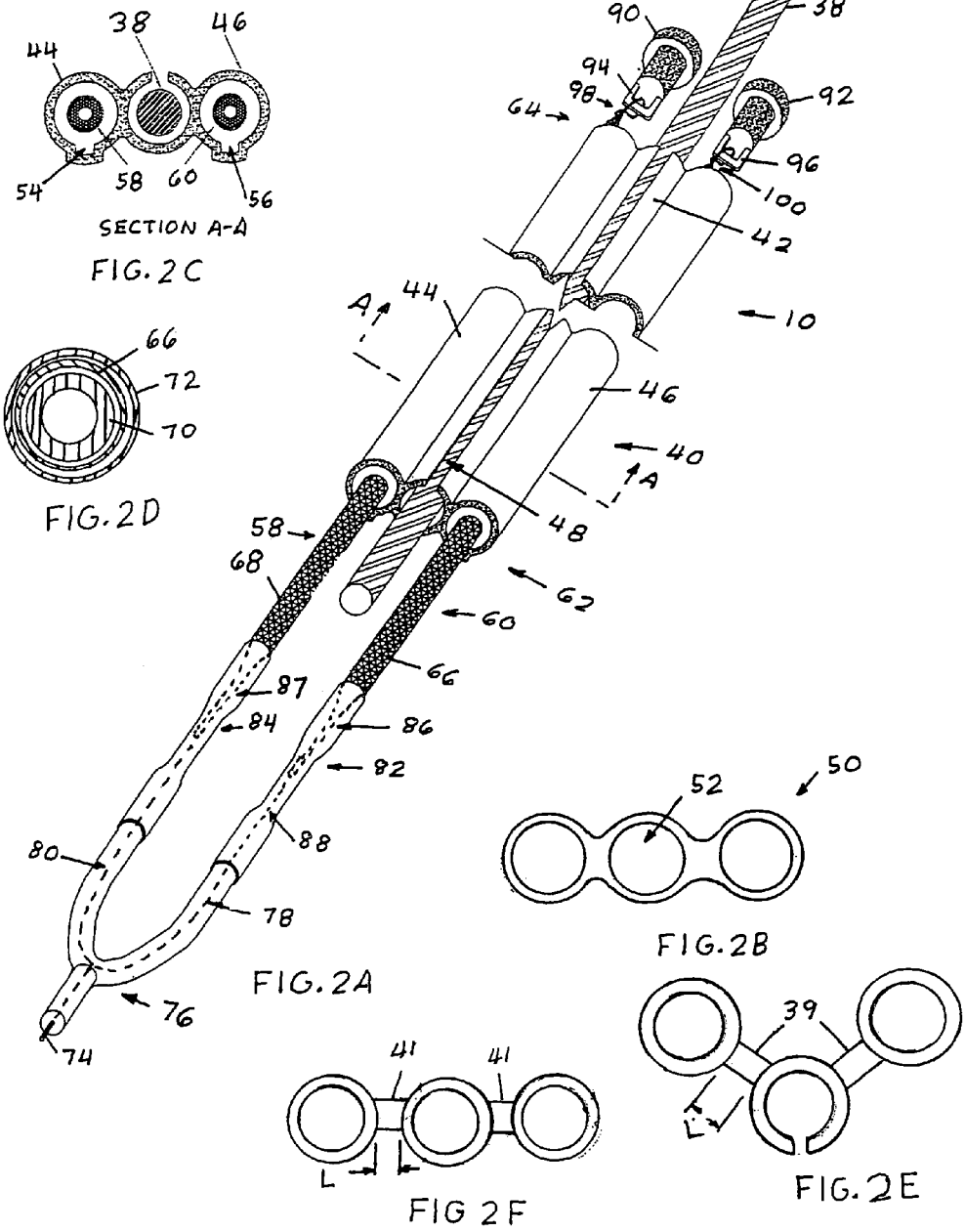
FIG. 2A shows details of the split lead antenna mounted on a backstay.
FIG. 2B illustrates a support apparatus with a non-slotted center tube.
FIG. 2C is a cross-sectional view A—A of FIG. 2B showing a support apparatus, radiators and backstay.
FIG. 2D is a detailed cross-sectional view illustrating the construction of a radiator.
FIG. 2E shows a support structure with a center tube for attaching to a backstay displaced from the plane of outer tubes containing the radiators.
FIG. 2F shows a support structure with tubes spaced apart with struts.

One embodiment of the split lead antenna assembly 10 of FIG. 1 is shown in greater detail in FIG. 2A mounted on a backstay 38. A three-channel support apparatus 40 is shown to include a center tube 42, and first and second outer tubes 44 and 46 attached to and spaced apart by the center tube 42. The center tube 42 as shown in FIG. 2A has a slot 48 running the entire length of the tube 42 for the purpose of allowing a backstay 38 to be forced through the slot 48 to the inside of the tube 42 as shown for securing the antenna 10 to the backstay 38. A function of the outer tubes 44 and 46 is to contain and position radiator apparatus 58 and 60 spaced apart on either side of a backstay 38. Other methods of securing two parallel radiator apparatus to a backstay are also included in the spirit of the present invention. For example, FIG. 2B shows a three channel/tube support apparatus 50 without the center slot 48. This configuration requires one end of the backstay to be disconnected to run the backstay through the center tube channel 52. Although the figures of the drawing show the backstay and outer tubes all lying in a common plane, the present invention also includes the backstay displaced above or below the plane defined by the first and second radiators, with the backstay substantially equidistant from each radiator, as shown in FIG. 2E. The three tubes can also be separated by any of various types of supports, such as struts 39 and 41 shown in the end views of FIGS. 2E and 2F. The struts can extend the entire length of the tubes, or they can be spaced apart segments. The struts can be of any desired length "L", depending on the required/desired spacing L between the tubes.

FIG. 2C is a sectional view A—A of the split lead antenna 10 of FIG. 2A, illustrating the inclusion of water drain channels 54 and 56 in the outer tubes 44 and 46, allowing water to drain more readily from the tubes 44 and 46.

Radiator apparatus 58 and 60 extend substantially through the outer tubes 44 and 46 from a proximal end 62 to a distal end 64 of the assembly 10. Referring to FIG. 2D in reference to radiator apparatus 60 for example, the radiator apparatus has a conductive element 66, shown as braided wire, supported by an insulative hollow-tube 70. An outer insulator sleeve 72 is shown covering the conductive element 66. For example, the hollow tube 70 can be a plastic tube of polyethylene (HDPE) with an inner diameter of ⅛" and an outer diameter of ¼". The outer sleeve can be a 1/64" thick HDPE jacket, factory extruded over the metal braid conductor 66 to prevent water ingress and corrosion. The radiator apparatus as specifically described in FIG. 2D is designed to take advantage of an RF phenomenon called the "skin effect," which is the tendency of RF energy to travel only along the surface of a conductor. This means that any conductor is essentially "hollow" from an RF point of view. The hollow conductors minimize weight and cost without reducing RF performance. High-density polyethylene is specified for both the center tube 66 and outer jacket 72 of the RF radiator apparatus for a number of reasons including:

1. HDPE is an outstanding electrical insulator.

2. HDPE presents a smooth "bearing surface," allowing the RF radiator apparatus 58 and 60 to slide easily into the outer tubes 44 and 46 of the split-lead tube arrangement.

3. HDPE provides an ideal combination of both stiffness and flexibility, so that it can be easily coiled for shipment and stowage, but also straightened for insertion into the split-lead tube.

4. HDPE is approximately 30% lighter than PVC and is about the same cost to extrude in production quantities.

A variety of metal braid constructions can be specified for the RF radiator apparatus, depending upon how much current flow is expected to occur along them. One embodiment has a braid construction of 36 gauge copper wire, coated with silver to a minimum coverage of 85%, braided into a tubular arrangement consisting of 24 strands with a total of 7 wires per strand. Current carrying capacity is rated at 32 AC amps, which greatly exceeds the current-carrying requirements of sailboat HF antenna systems. This 36×24×7 braid arrangement minimizes cost and weight. In addition, the fine gauge wires in this braid present a large total surface area for the RF current to travel upon, in a fashion similar to Litz or magnet wire.

Referring again to FIG. 2A, the conductive elements 66 and 68 of the two radiator apparatus 58 and 60 are electrically connected together and also to a lead wire 74 substantially at a proximal end of the antenna assembly 10. This connection of the two conductive elements 66 and 68 to the lead-in wire 74 can be accomplished in any of a variety of ways that will be apparent to those skilled in the art, and these are to be included in the spirit of the present invention. FIG. 2A illustrates a three way junction 76 joining the lead wire 74 to two wires 78 and 80, which are then joined to conductors 66 and 68 respectively through use of electrical splices 82 and 84. In order to connect to the splices 82 and 84, the sleeve 72 and hollow tube 70 of each radiator are cut back a distance, and the resulting unsupported wire braid conductors 66 and 68 are twisted and/or pulled to form smaller, compact conductors, illustrated for example by dashed lines 86 and 87 and inserted in the splices 82 and 84, into inner, metallic sleeve (not shown) portions of the splices. The splices are then crimped to secure the compacted conductors to the sleeves. A similar procedure is used to secure the lead wire 78 at 88 in a corresponding portion of the metallic sleeve, completing the connection between the conductor 66 and wire 78. This procedure is then used to secure the conductor 68 to wire 80 through splice 84.

At the distal end 64 of the antenna 10, plugs 90 and 92 are inserted into tubes 44 and 46 respectively. The plugs serve at least two functions. One function is to seal the top of the tubes 44 and 46 to prevent entry of water. This is achieved by applying a sealing adhesive to the mating surfaces and then inserting the plugs in the tubes. Another function of the plugs 90 and 92 is to secure the distal ends of the radiator apparatus 58 and 60. This is done by cutting back a length, for example of the outer sleeve 72 and hollow tube 70, and then compacting the braided conductive elements, and wrapping each around the corresponding eyelet 94 or 96 as at 98 and 100 to secure each radiator apparatus to the corresponding plug. The details of attachment between a radiator and plug are more clearly shown in FIG. 3 using the conductive element 68 and plug 90 for example. After looping the braided, compacted conductive element through the eyelet 94, the resultant braided loop can be soldered to itself, or the connection can be secured by other methods such as through use of an adhesive, or any or all of these with or without a shrink tube 99 collapsed over the connection to further secure it in place.

Figure 4:
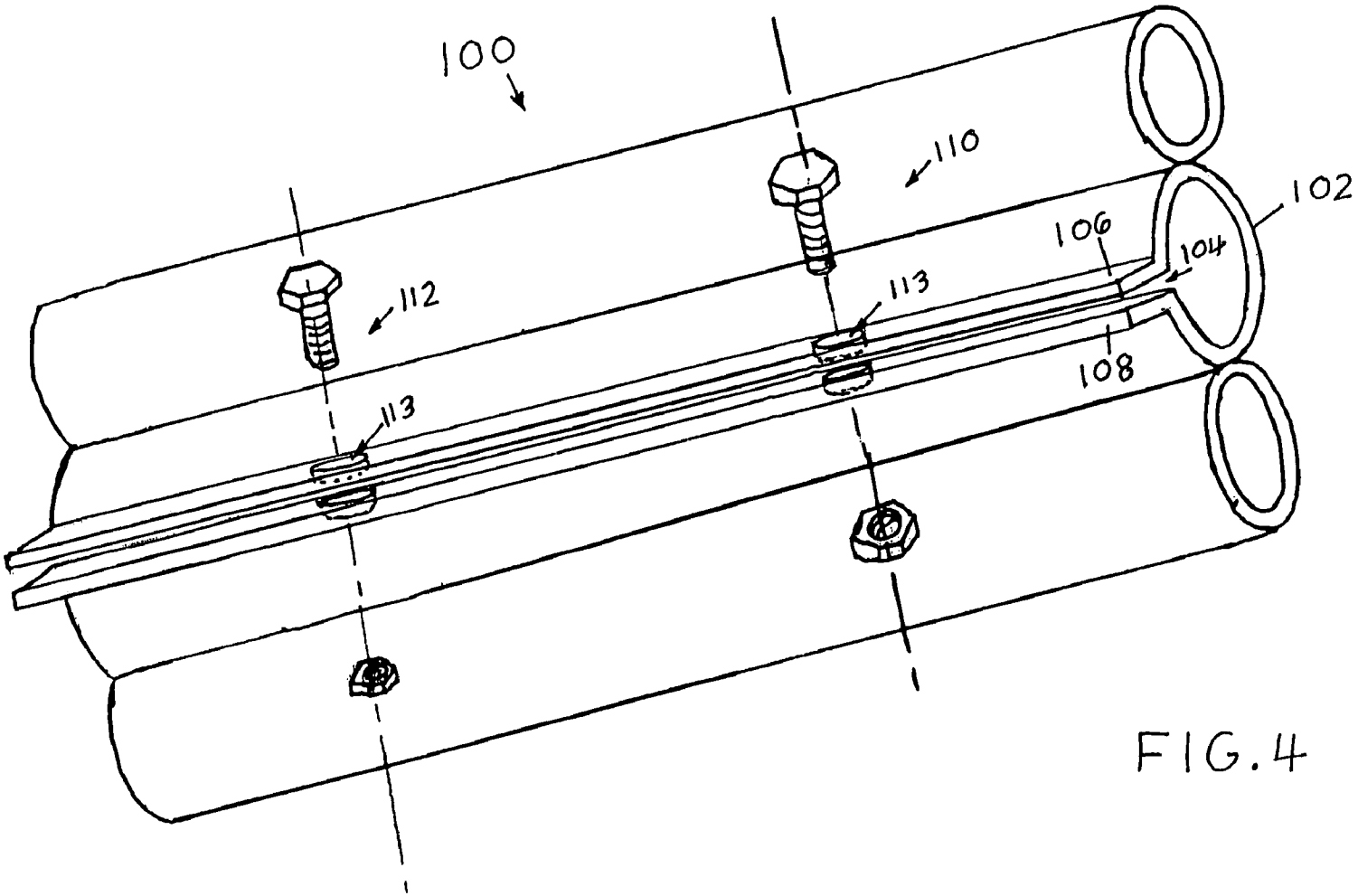
FIG. 4 shows apparatus for clamping a slotted center tube of a support apparatus to a backstay.

FIG. 4 shows an alternative apparatus for securing a three channel support apparatus 100 to a backstay. The center tube 102 has a slot 104 for pressing a backstay therethrough. In order to more securely grip the backstay in the tube 102, flanges 106 and 108 on opposite sides of the slot 104 are included for installing a nut and bolt pairs 110 and 112 and corresponding holes 113 in the flanges for forcing a degree of slot 104 closure, resulting in a reduced tube 102 diameter for securely gripping a backstay in the tube 102. Although continuous flanges are shown, the invention also includes any number and any spacing of separate flanges, and any number of spacing between flange holes 113. The present invention also includes other configurations of support apparatus for performing the functions of apparatus 100 that will be apparent to those skilled in the art upon reading the present disclosure. For example, the center tube 102 of FIG. 4 or 42 of FIG. 2A, could be replaced with a flat plate attached to outer tubes, and brackets of various designs can be used for securing the plate to a backstay. In further example, a slotted center tube could extend beyond the outer tubes on each end, allowing hose type clamps to be used to compress the tube and slot, and thereby grip the backstay.

Figure 5:
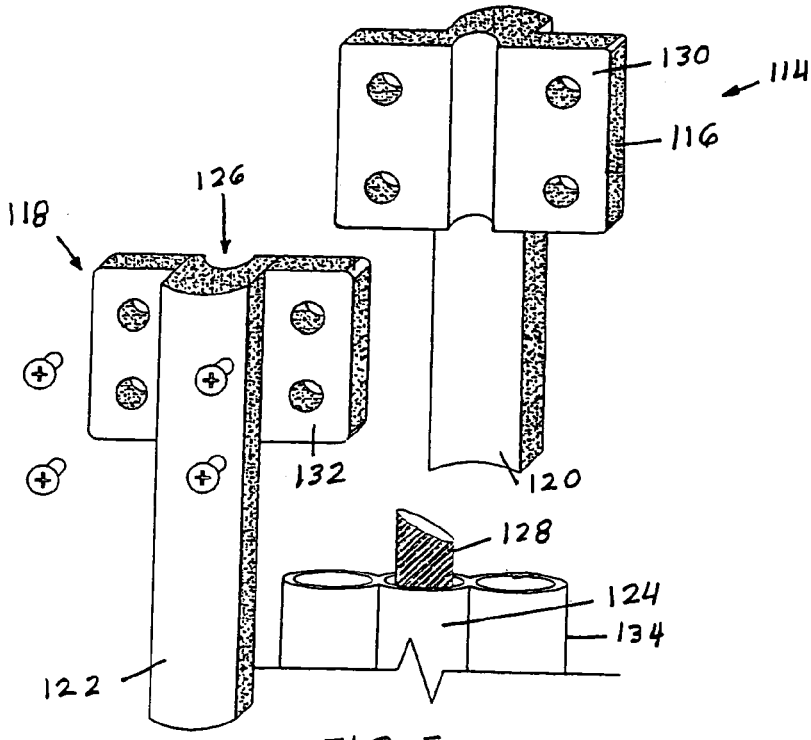
FIG. 5 shows a two-piece clamping apparatus for clamping a support apparatus to a backstay.

FIG. 5 shows another clamping apparatus 114 for clamping a center tube such as tube 42 of FIG. 2A to a backstay. The clamping apparatus is useful for installations where the center tube of the support apparatus is slit along its length to allow it to be pressed onto the support wire/backstay. The clamping apparatus 114 has two parts 116 and 118, for example constructed of plastic that are clamped tightly around a backstay, with one pair at the top and another at the bottom end of a support apparatus. Each two part clamp apparatus is positioned on the backstay so that the curved flanges, 120, 122 press down and grip the center tube. As illustrated, extensions 120 and 122 are positioned over the center tube 124. A reduced diameter 126 is configured for a tight fit around the backstay 128. The extensions 120 and 122 may be configured for an interference fit with the center tube 124, for applying a strong compressive force when flanges 130 and 132 are bolted together on the backstay.

Figure 6:
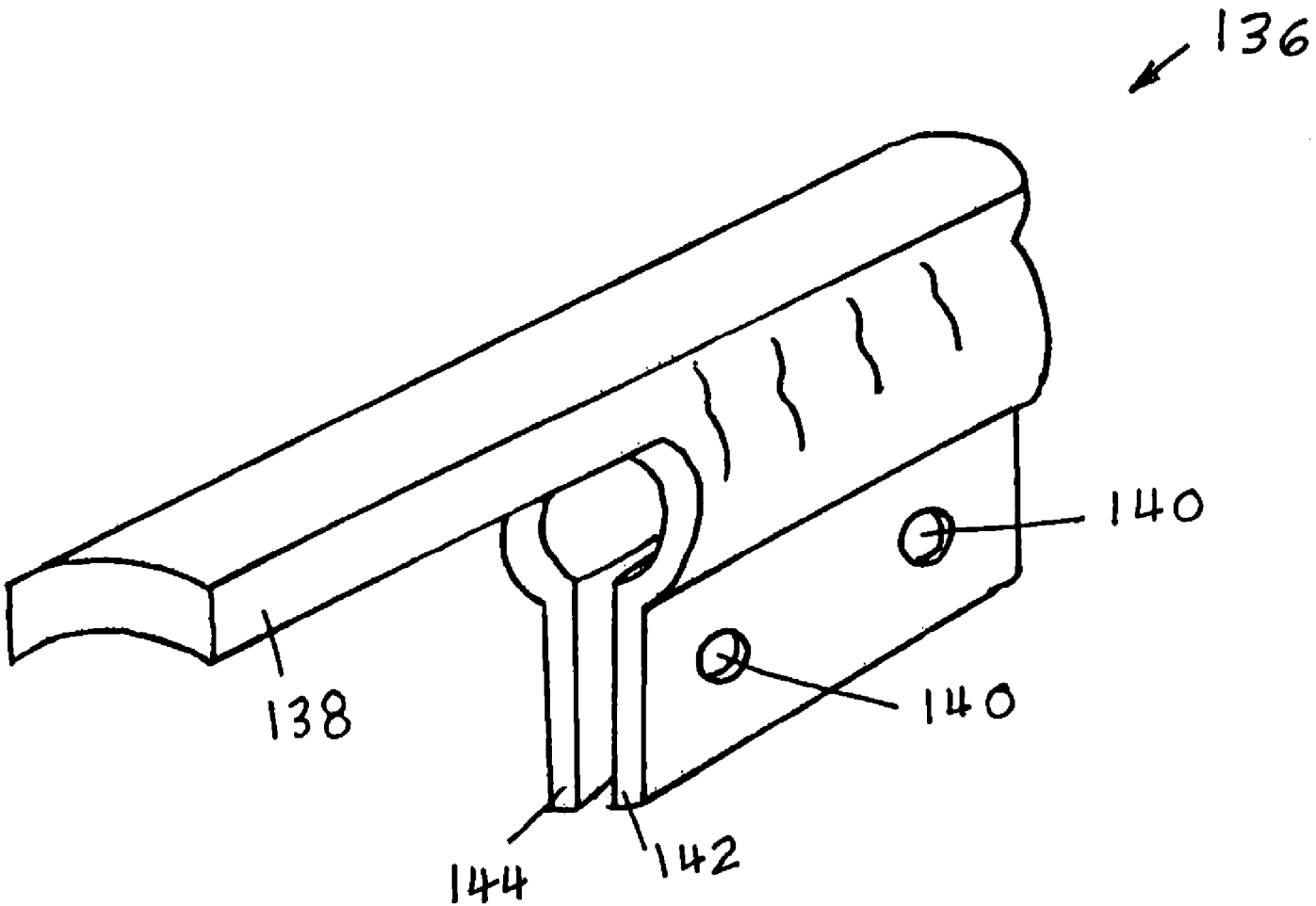
FIG. 6 shows a clamp for retaining a non-slotted center tube to a backstay.

An alternative clamping apparatus 136 is illustrated in FIG. 6. Apparatus 136 is useful where the center tube of a support apparatus is not slotted, for example as shown in FIG. 2B, and where the support wire/backstay does not have pre-existing swages or fittings. Two of the clamping apparatus 136 are used, including one for securing at the top of a support apparatus and a second for securing at the bottom of the support apparatus. In this example, the backstay must be disconnected, and both of the clamping apparatus 136 and the support apparatus are fed/slid onto the backstay. The flanges 138 then slide over the center tube at the top and bottom of the support apparatus, and grip the support wire/backstay by means of a nut and bolt arrangement through holes 140, pulling the two flanges 142 and 144 together and clamping the apparatus 136 to the backstay. Both clamping apparatus designs of FIGS. 5 and 6 can be produced inside a multi-cavity injection mold. They can be constructed either from Delrin or HDPE. The machined holes 140 can be dimensioned for #10-32 stainless steel fasteners.

Figure 7:
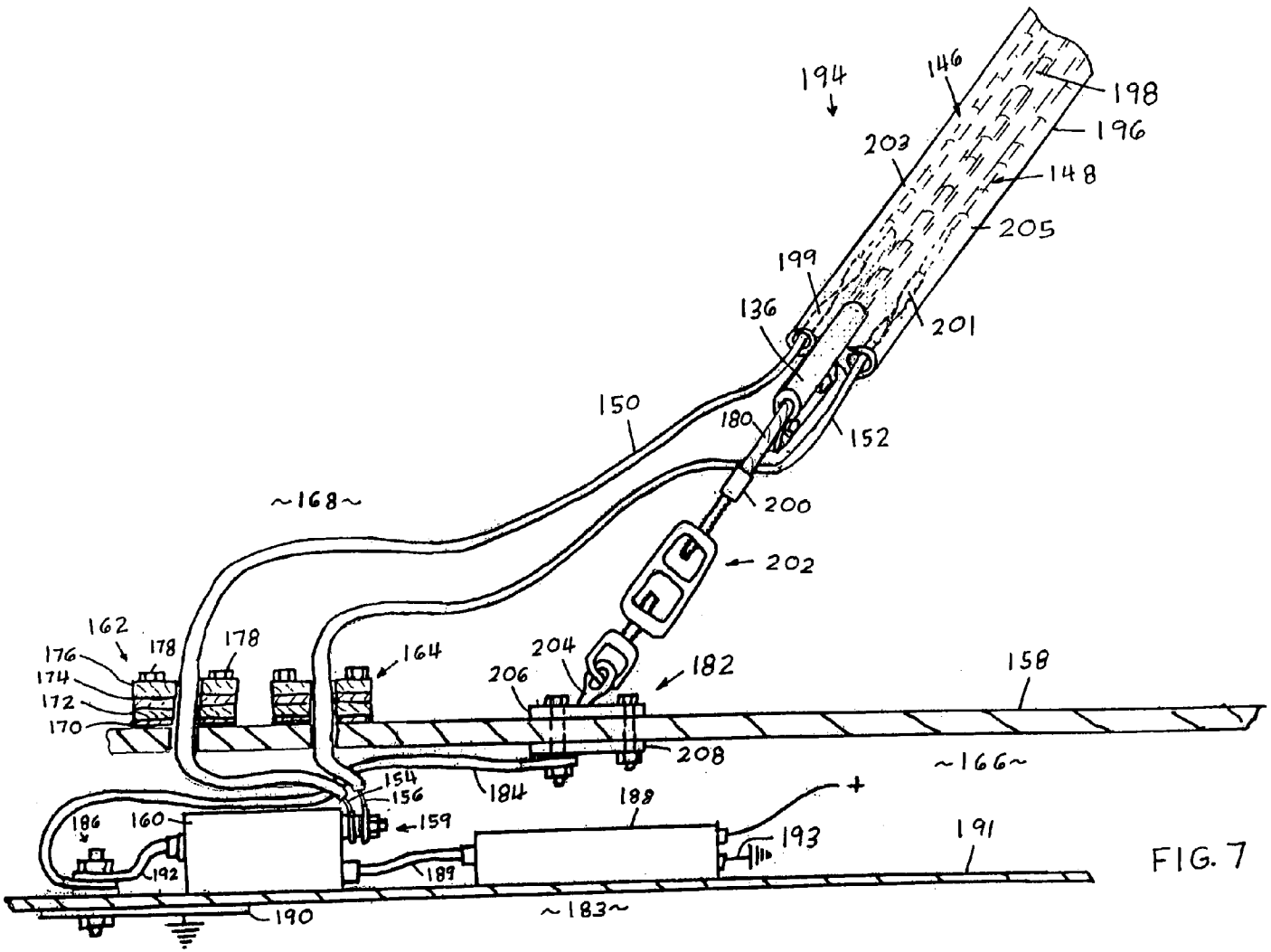
FIG. 7 shows use of a clamp, and ground connections.

FIG. 7 shows a further embodiment of the present invention wherein each of two radiators 146 and 148 are attached to lead-in wires/cables 150 and 152 respectively. Instead of joining the conductive elements 154 and 156 above the deck 158 of the boat, the elements 154 and 156 are joined in a weather protected area illustrated for example as area 166 below the deck 158 of the boat. With the elements 154 and 156 in a weather protected area, they can be joined together in any of various ways that will be apparent to those skilled in the art. FIG. 7 shows the elements 154 and 156 joined electrically at an antenna stud/terminal block 159 of an antenna tuner 160. The wires 150 and 152 are shown fed through the deck 158 of the boat by way of thru-deck-lands 162 and 164, which can be any type of feed-thru that seals so as to keep moisture from getting into the inside 166 from the outside 168. The thru-deck-lands 162 and 164 include a first seal 170 clamped to the deck with bolts/screws running through a plastic plate 172 into or through the deck 158. A flat flexible seal material 174 is placed between plate 172 and a top plate 176. The complete stack is then bolted to the deck with bolts 178, compressing the seal 174 and thereby causing it to expand laterally and apply pressure to seal the diameter of cable/wire 150.

The conductive backstay 180 is shown attached to the deck 158 through a mount 182. The particular embodiment of the mount 182 shown in FIG. 7 includes a rigging tong 204 and chain plate 206 welded together, and a backing plate 208. FIG. 7 also shows detail of the backstay mounting, including a swage/stud 200, and a rigging screw 202. As an alternative embodiment, the mount 182 provides an electrically conductive path from the conductive backstay 180 to a wire/cable 184 connected to a ground connection 186. The ground connection 186 can be any ground point that is common to the transceiver 188 and the tuner 160, but as shown, the ground of the antenna and transceiver system are connected to a ship "ground," indicated for example by a metal plate 190 on the outside of the ship hull 191 and therefore generally in contact with sea water 183. The tuner 160 is shown connected to a ground by wire 192 to the ground connection 186. The ground for the transceiver 188 can be accomplished in any of various ways that will be apparent to those skilled in the art, and is symbolically illustrated as line 193. The transceiver 188 input/output is connected to the tuner 160 by way of coax cable 189.

FIG. 7, for ease of illustration, only shows a lower portion of an antenna assembly 194. The antenna radiators 146 and 148, and three channel support apparatus 196 extend upward to a distal end similar to that shown in FIG. 2A, with apparatus for securing the distal ends of the radiators to the support apparatus 196, such as using plugs as shown in FIG. 2A. The support apparatus 196 may include a slotted or un-slotted center tube 198, and may have clamping apparatus such as clamp 136 shown, or other clamping apparatus at the top and/or bottom of the support apparatus 196. The clamping apparatus can also be used as an alternative embodiment to the above described antenna structures such as described in reference to FIG. 2A. Furthermore, the alternative use of common grounding of the backstay and tuner and transceiver, and connections to the boat ground also applies to the antenna structures described above as an alternative embodiment. FIG. 7 shows splices 199 and 201, such as splices 84 and 82 of FIG. 2A positioned inside the outer tubes 203 and 205, providing protection of the connections from moisture and other environmental conditions. Similarly, the splices 82 and 84 of FIG. 2A can be positioned inside tubes 44 and 46.

The following comments are provided for further explanation of the application and advantages of the present invention.

The split-lead antenna configurations as described above can either be slipped over an existing support wire/backstay, or "press fit" between existing wire swages and fittings that may be in place on a backstay. This greatly simplifies the installation of an antenna system, since the specialized wire-cutting and swaging skills and tools required for many prior art systems are not required with use of the antennas of the present invention. The split-lead system also enhances the mechanical integrity of the wire rope/backstay, since the wire is not longer interrupted by swages and plastic insulators along its length. The elimination of RF insulators is especially significant for sailboats. These vessels commonly use insulators in their backstay wires, which although relatively fragile, are critical to the support of the mast. The failure of an insulator or its swage could result in the damage or loss of the mast. For this reason, at least one major marine retailer has specified to its customers that "backstay insulators generally have a shorter lifespan than other rigging components, and should be checked regularly."

Wire-rope antenna elements on oceangoing sailboats that use the insulators in series to isolate the length of antenna from the remainder of the backstay, form an integral part of the vessel's standing rigging, and must accept potentially severe mechanical loads from the mast. In addition, the uninsulated wire-rope antenna elements generally used are directly exposed to rain, salt spray, etc., and must be highly corrosion resistant. For these reasons, wire-rope sailboat antennas are almost always made from stainless steel, which is not an optimum electrical conductor. Stainless steel is a relatively inefficient electrical conductor, possessing only about 3% of the electrical conductivity of copper. Indeed, wire rope antenna systems are designed to carry mechanical loads and no consideration is given to their current-carrying capacity. In contrast, the split-lead antenna radiator apparatus of the present invention receives no mechanical loads and is carefully shielded from the corrosive effects of rain, salt spray and moisture, which eliminates the need for the high tensile strength and corrosion resistance of stainless steel. These factors allow the split-lead antenna to use either tinned or silver-plated copper RF conductive elements, which are two of the most highly conductive materials available, while continuing to utilize an unbroken length of stainless steel wire-rope/backstay as a strong and relatively lightweight mechanical support.

The use of the split-lead antennas of the present invention, instead of the wire-rope antenna using series insulators, could prove significant to the U.S. Navy, which currently specifies 5/16" diameter phosphor bronze for its wire-rope antenna systems. Phosphor bronze is specified due to its superior conductivity relative to stainless steel, in spite of the fact that stainless steel possesses a breaking strength nearly three and a half times as great. By switching to a split-lead antenna, a stainless steel support wire could be specified in place of phosphor bronze, increasing mechanical strength by a factor of 3.5:1 and electrical conductivity by a factor of 10:1 over phosphor bronze.

Wind-blown precipitation (snow, rain, sleet, etc.) impacting a bare wire-rope antenna causes a form of natural interference called precipitation static. This static is greatly reduced when the wire rope is jacketed with an insulating material. However, jacketing a conventional wire antenna is problematic in a marine environment, since doing so tends to increase the rate of corrosion on the wire. This increased rate of corrosion is caused by water, often mixed with salt and corrosive exhaust residue, wicking its way between the insulating jacket and the wire rope itself. Under these conditions, even "non corrosive" metals such as phosphor bronze and stainless steel can rapidly corrode. In the 1980s, for example, the United States Navy jacketed its phosphor-bronze wire rope antennas with vinyl to try to reduce precipitation static. Static was reduced, but the corrosion rate of the wire-rope radiators was increased to an unacceptable degree. The water's point of entry occurred at the top and bottom ends of the antenna and wherever the vinyl jacketing was terminated, for example at in-line voltage insulators, connectors, etc. Since the wire-rope receives constant mechanical stresses from the vessel, any kind of sealant placed at these termination points eventually cracks open and allows water ingress and subsequent rapid corrosion of the jacketed phosphor-bronze antenna wires.

Unlike the Navy antennas described above, the split-lead antenna radiator apparatus of the present invention is housed within oversized HDPE plastic tubes. The tubes are capped and sealed at the top and these seals are not subject to mechanical stresses that might otherwise compromise their watertight integrity. The tubes are left open at the bottom to allow any water condensation or leakage that does occur to drain out through full-length water drainage channels. This design shields the RF radiators from precipitation static and potential shorts to ground while minimizing the corrosion associated with conventional wire jacketing.

Because the RF radiator apparatus on the split-lead antenna are each housed in separate tubes, they can easily be connected to an antenna lead-in wire by means of an electrical Y-splice and heat-shrinkable tubing. The connections are simple and watertight. This arrangement is in contrast to the HF antenna/lead wire connections found on most sailboats, where the lead-wire jacket is simply stripped and bare copper wire is wrapped around a backstay wire. A few servings of electrical tape are then applied, often followed by a hose clamp. Understandably, these connections represent one of the most common sources of corrosion-induced RF current loss aboard sailboats.

Another advantage of the split-lead antenna of the present invention is that it can easily be removed and slipped onto a new wire. Its various components can also be removed and replaced as necessary. In contrast, swaged RF in-time insulators form a permanent part of the wire rope/backstay to which they are attached and are therefore not easily replaced.

Conventional wire rope antennas, with their exposed radiators, pose a high voltage shock hazard. This hazard is potentially severe aboard sailboats, where boat motion can be considerable and insulated backstays often serve as handholds. Since the split-lead antenna radiators are encased in plastic tubing, there is no potential shock hazard posed by touching the antenna element during tune-up or transmission.

Figure 8:
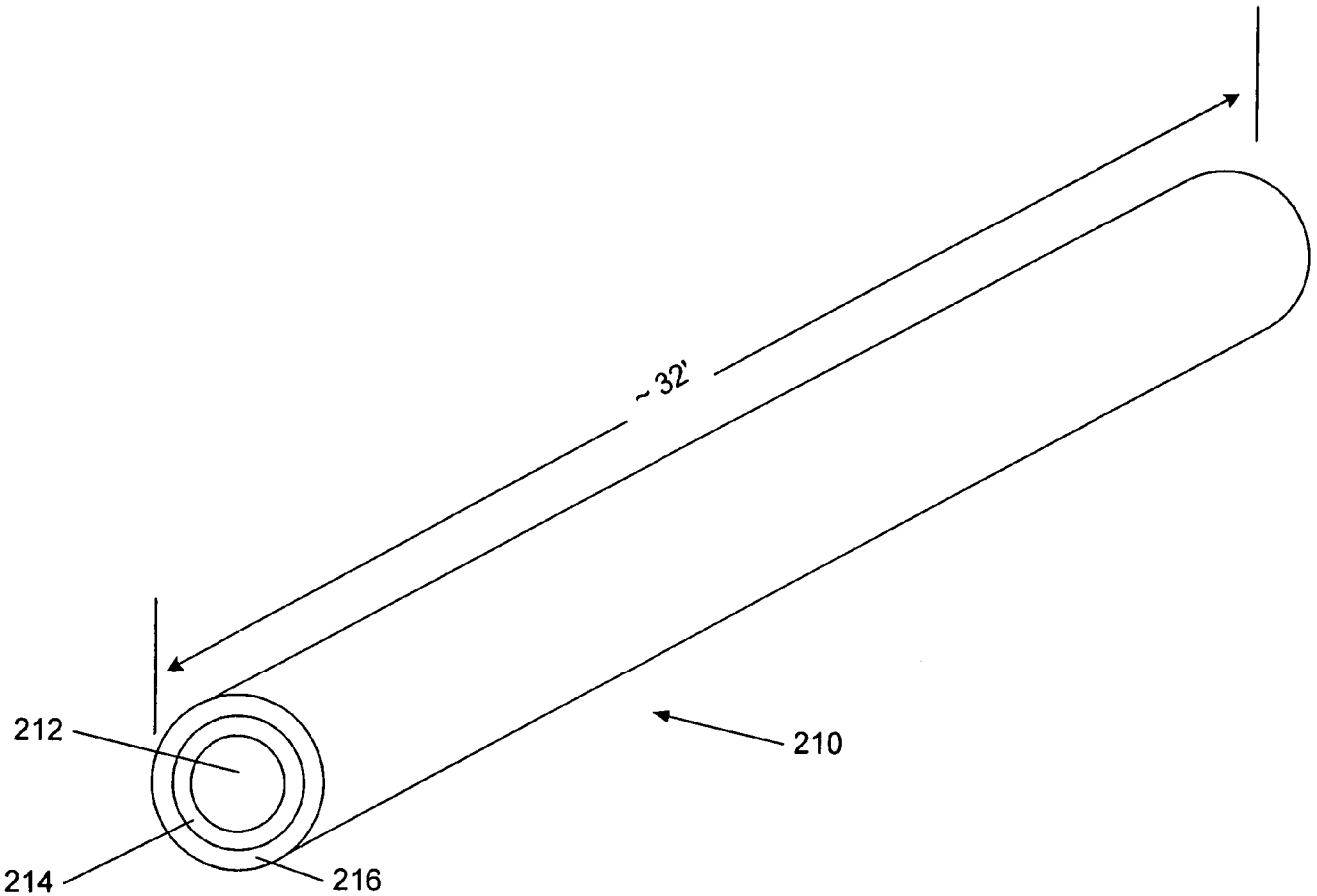
FIG. 8 illustrates a solid core radiator.

FIG. 8 shows an alternate construction of the radiator apparatus. Referring to FIG. 2A, radiator apparatus 58 and 60 are described as having a hollow tube 70 upon which the conductor material is formed. In FIG. 8, a radiator 210 apparatus is shown that has a solid core 212 with an electrical conductor 214 thereon. An insulating layer/jacket 216 covers the conductor 214. The solid core/rod 212 can be made of polyethylene (HDPE) with a diameter of 1/8 inch for example. The conductor material 214 can then be formed over the rod 212 and then an insulating layer/jacket 212 formed over the conductor material 214. The use of a solid core 212 has an advantage over the hollow core tube in that the solid core can withstand higher processing temperatures without distorting. This is an advantage when high temperatures are used in forming the jacket 216 over the conductor 214. Another advantage of the solid core is that the total radiator diameter can be reduced. A typical length of the radiator 210 would be 32 feet for construction of a HF (high frequency) antenna for use in the 1.9–3.0 MHZ frequency range. In use, the conductor 214 can be a braided material. The rod 212 and jacket 216 can be cut back in order to extend the conductor portion for making an electrical contact in a similar manner as shown in FIG. 2A. The conductor 214 and jacket 216 can each be for example about 1/64 inch thick.

Figure 9:
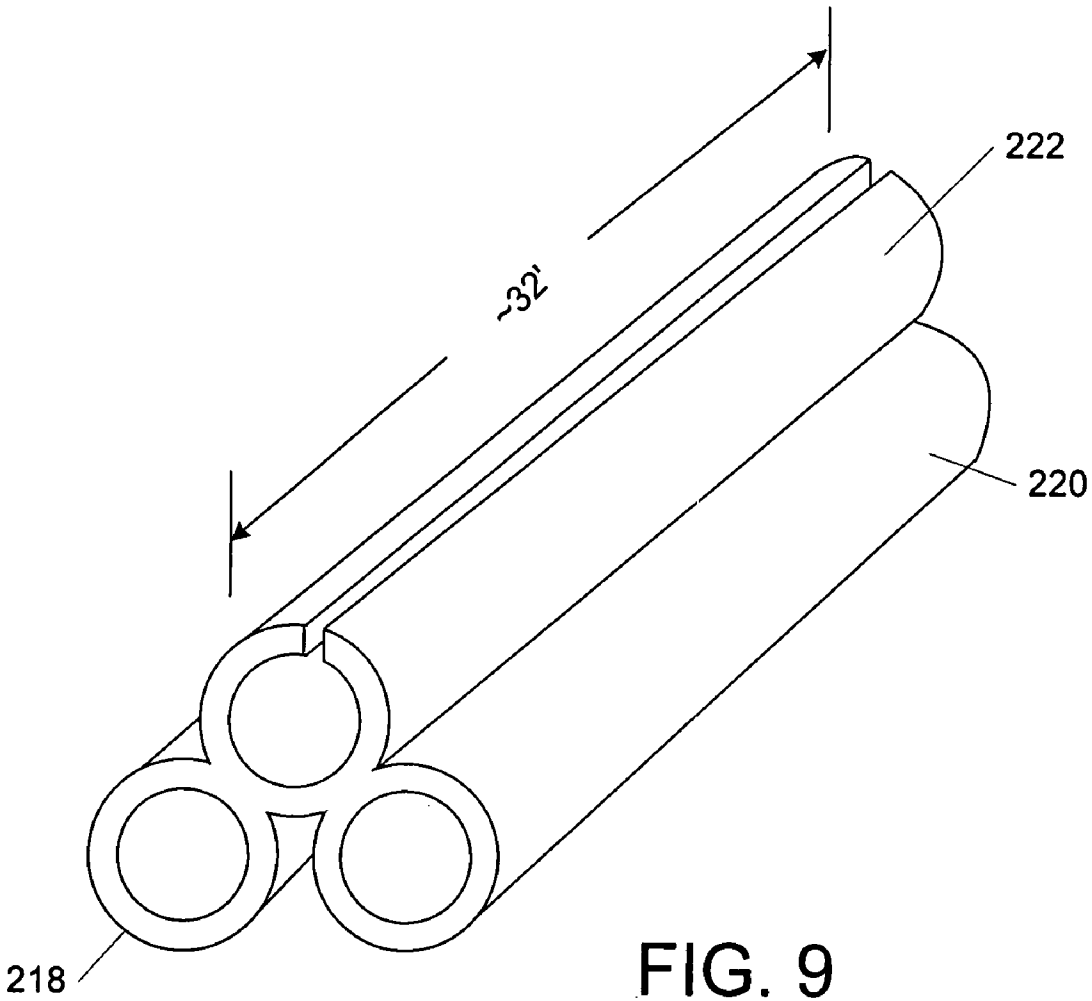
FIG. 9 is a perspective view of offset radiator tubes.

A further alternate embodiment of the antenna housing is shown in FIG. 9. The radiators, such as 58 and 60 of FIG. 2A and 210 of FIG. 8 are placed in the outer tubes 218 and 220, and the center tube 222 in operation is forced over the backstay. The outer tubes 218 and 220 are offset, similar to FIG. 2E, and in addition are joined with the center tube 222 without the use of joining members such as items 39 shown in FIG. 2E. An advantage of this arrangement is a smaller overall cross section/profile, and in operation has less wind resistence/windage.

Figure 3:
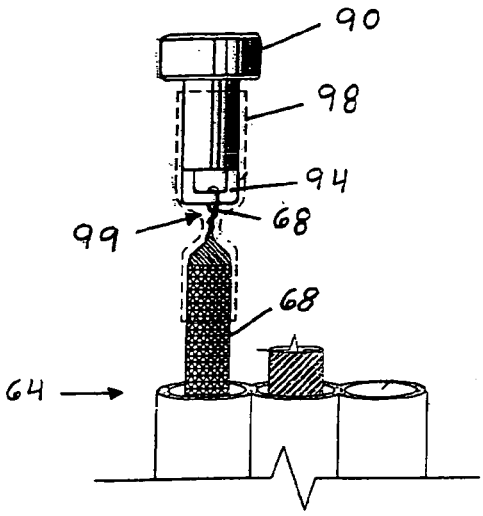
FIG. 3 illustrates the attachment of the distal end of a radiator to a plug.
Figure 10:
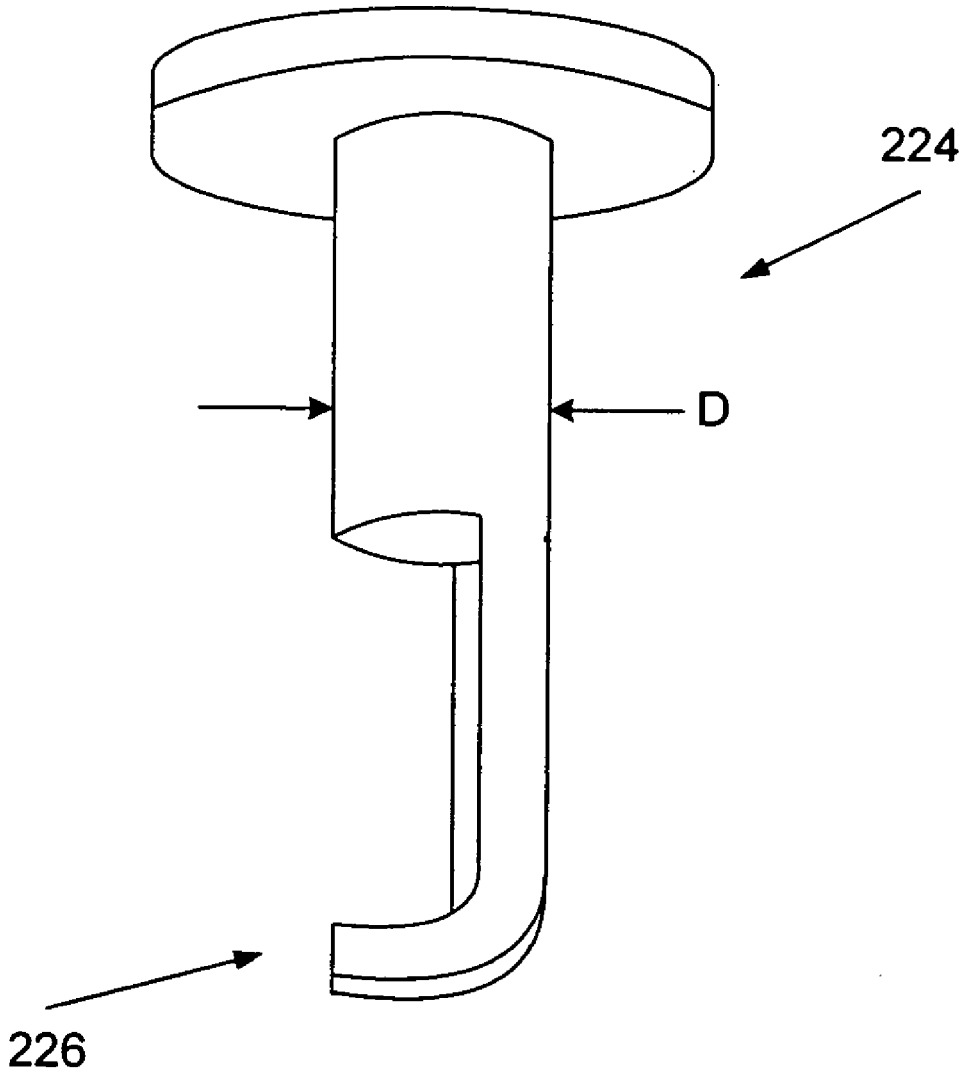
FIG. 10 shows a water plug with a hook for securing an end of a radiator.

FIG. 10 shows an alternate water plug 224 design, serving the same purpose as the plug 90 of FIG. 3. Plug 224 uses a hook 226 instead of the closed loop/eyelet 94 of plug 90. The hook design of FIG. 10 allows a smaller plug diameter D as compared with the solid loop/eyelet of plug 90.

Figure 11A:
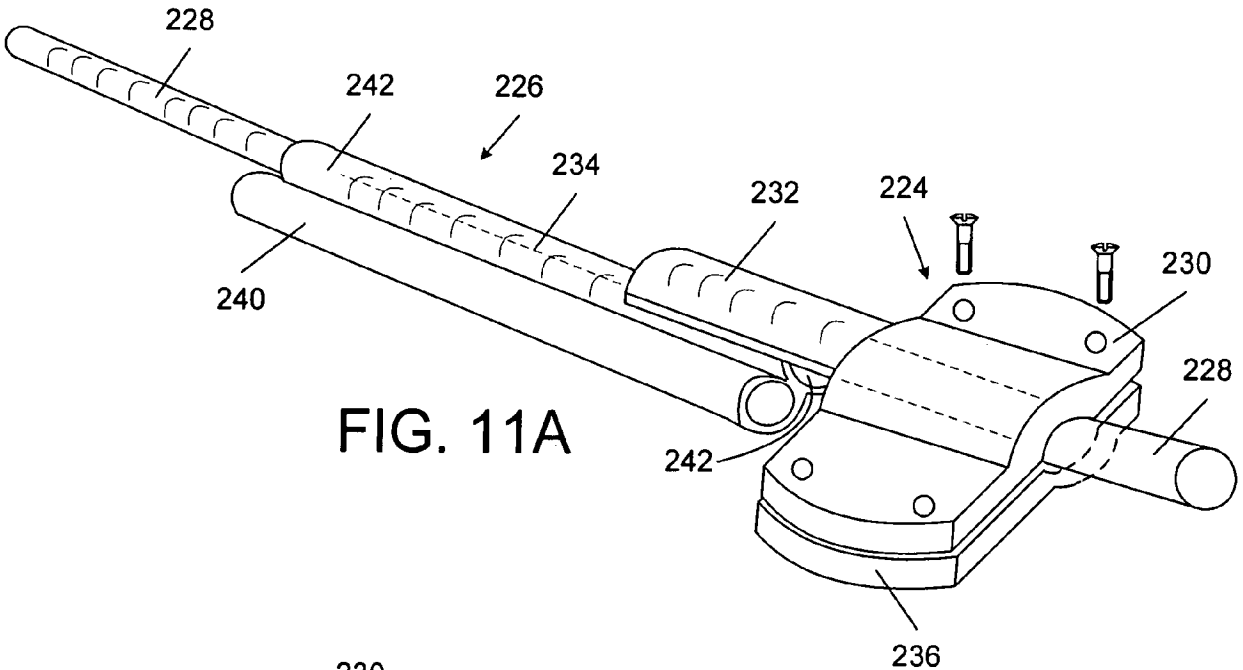
FIG. 11A shows a top clamp part with flange for securing an antenna housing on a backstay.

FIG. 11A illustrates a two piece clamp apparatus 224 for use in securing an antenna housing 226 to a backstay 228. For clarity of illustration, the radiators are not shown in FIG. 11A or 11B. The clamp 224 has one part 230 that has an elongated flange 232 that extends over the center tube 234 of the antenna housing 226. The other mating part 236 is shown without a corresponding flange due to the offset radiator tubes 240 and 242. Alternatively, a flange similar to flange 232 can be included in clamp mating part 236, and would be configured for fitting between tubes 240 and 242.

Figure 11B:
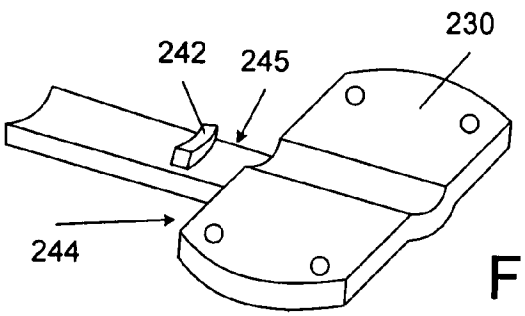
FIG. 11B shows a bottom view of the top clamp part with a standoff flange for restraining the antenna housing to provide clearance for radiator conductors.

If the outer tubes 240 and 243 are spaced closer to 180° apart, the mating clamp 236 portion can have the same elongated flange 232 as portion 230. The clamp parts 230 and 236 have contoured edges, shown for an esthetic and aerodynamic appearance. FIG. 11B shows a bottom view of clamp portion 230, showing an alternative embodiment standoff 242 for holding an end of the housing 226 away from the clamp face 244, and thereby providing clearance 245 for extension of the conductor portions of the radiators and making an electrical connection.

Figure 12:
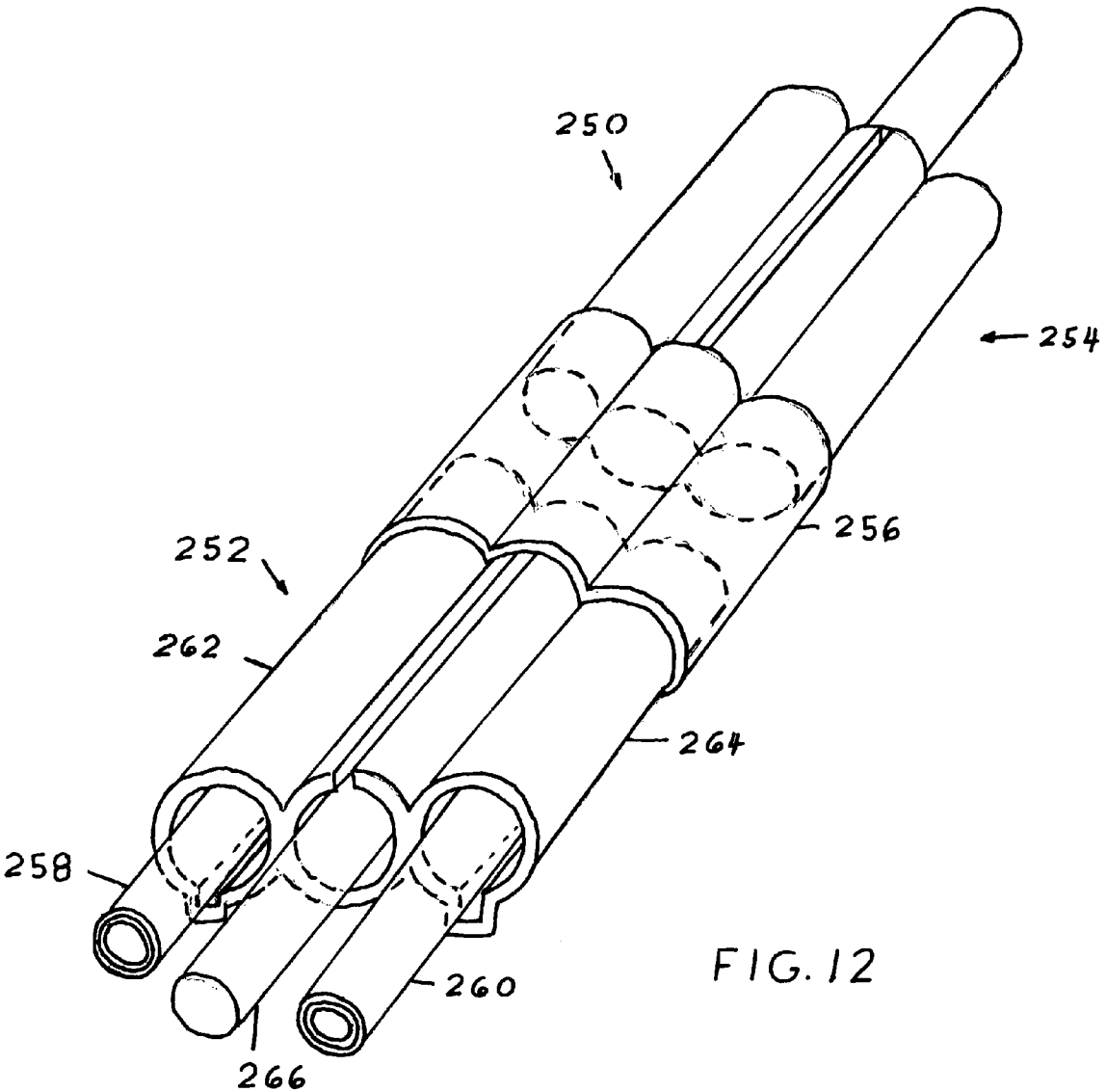
FIG. 12 shows use of a coupler for joining segments making up the length of an antenna housing.

FIG. 12 shows an alternative embodiment of an antenna housing for the parallel radiator/split lead antenna of the present invention. The housing 250 is assembled together in short, straight sections such as 252 and 254. The sections are joined together with plastic couplers 256, until the desired overall antenna length has been achieved. Full-length RF radiators 258 and 260 are then inserted into the outer tubes such as 262 and 264 of the housing 250 and the entire assembly is either press fitted or slipped over a backstay/support wire 266 and held in place with clamps, and water plugs are installed, all in the same fashion as the non-sectional split-lead antenna assembly described above.

By specifying short lengths of antenna housing pressed together into plastic couplers during final assembly, the sectional split-lead antenna offers a wide range of shipping and stowage possibilities.

Figure 13:
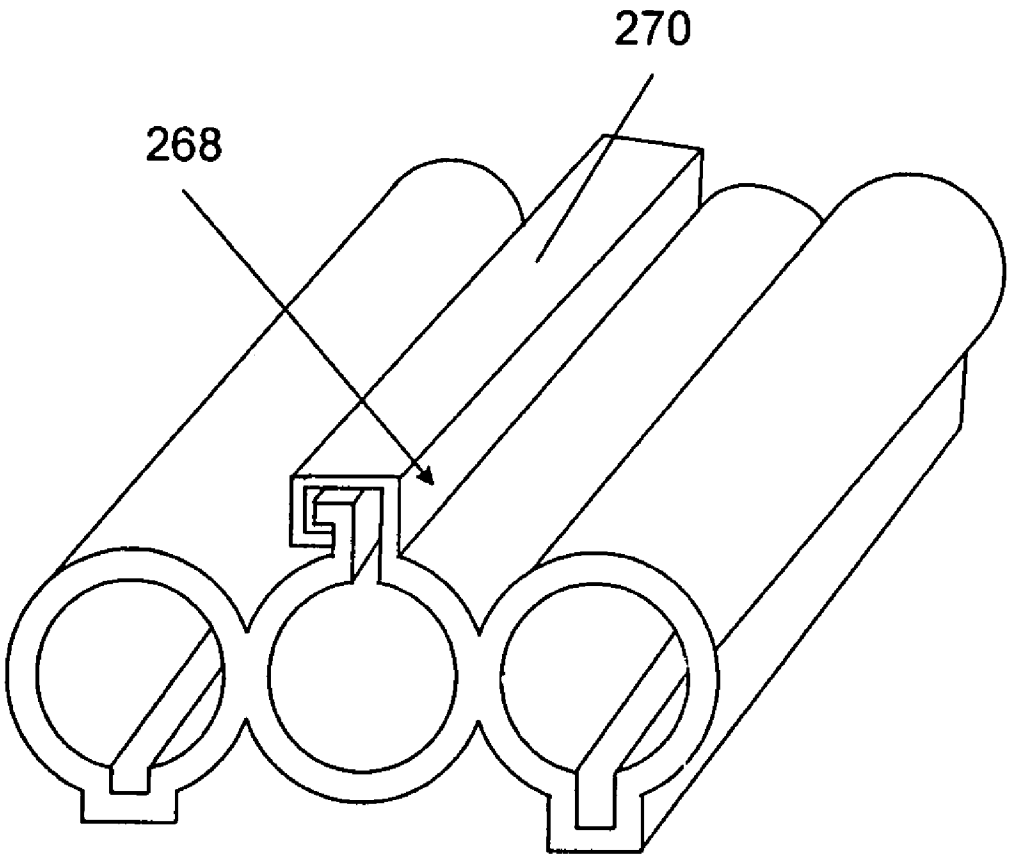
FIG. 13 shows use of a groove to channel apparatus for providing positive clamping of a housing on a backstay.

FIG. 13 shows a "Groove to Channel" configuration 268 as an alternative to the full-length slot 48 in the center tube 42 of the split-lead antenna housing as shown in FIG. 2A and other figures of the drawing. The arrangement 268 provides significant tensioning of the center tube 270 to the support wire over which it is installed, thereby eliminating the need for end clamps to hold the antenna in place. FIG. 13 is also presented as an illustration of a Groove to Channel enclosure construction for the couplers 256 described in reference to FIG. 12, which can also be constructed with the Groove to Channel feature to provide positive tension on the tubes 252 and 254.

Figure 14:
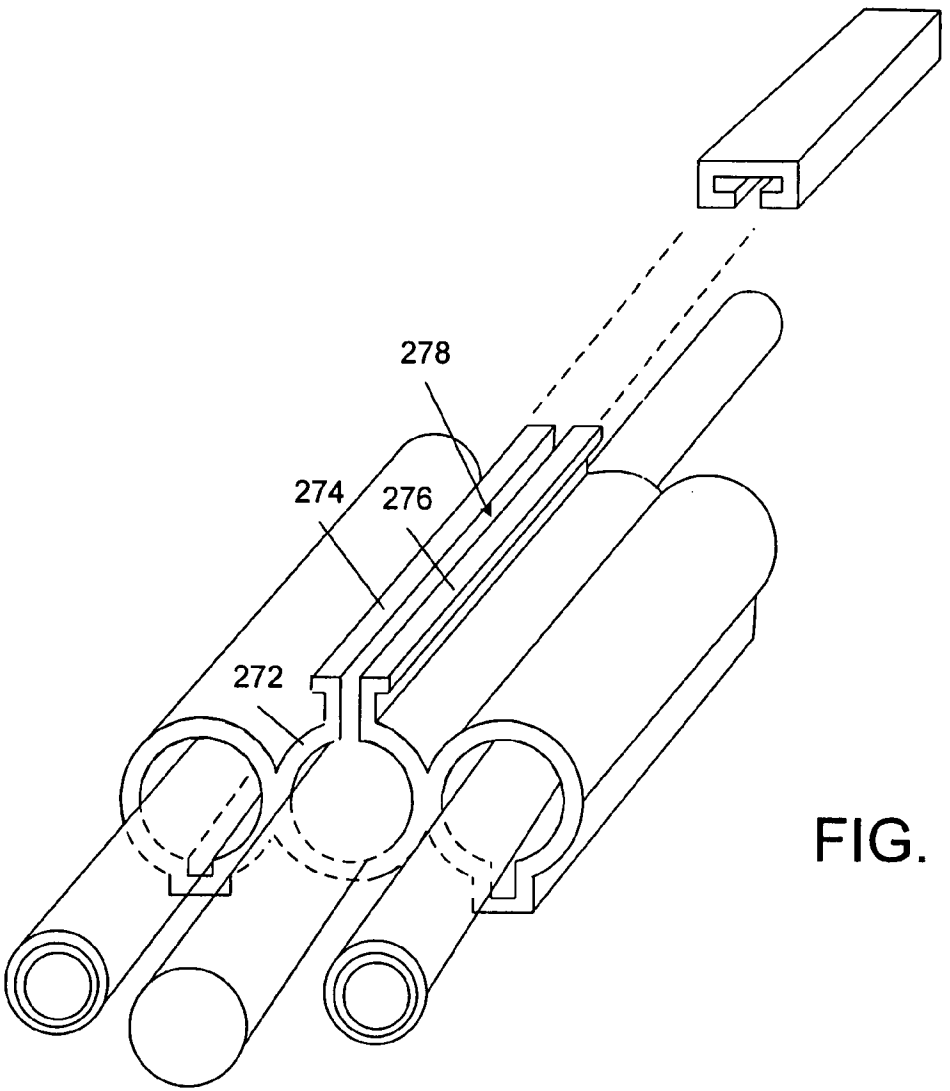
FIG. 14 illustrates flanges and a bracket for tensioning a housing tube to a backstay.

FIG. 14 shows another construction for providing tension on a slotted center tube 272 to a backstay 273. The tube 272 has flanges 274, 276 extending outward from the slot 278. A bracket 280 is provided for forceful engagement on the flanges 274, 276. This arrangement provides significant tensioning of the center tube to the support wire, thereby eliminating the need for end clamps to hold the antenna assembly in place. This Flange and Bracket assembly could also be specified for the antenna couplers 256 described in reference to FIG. 12.

Figure 15:
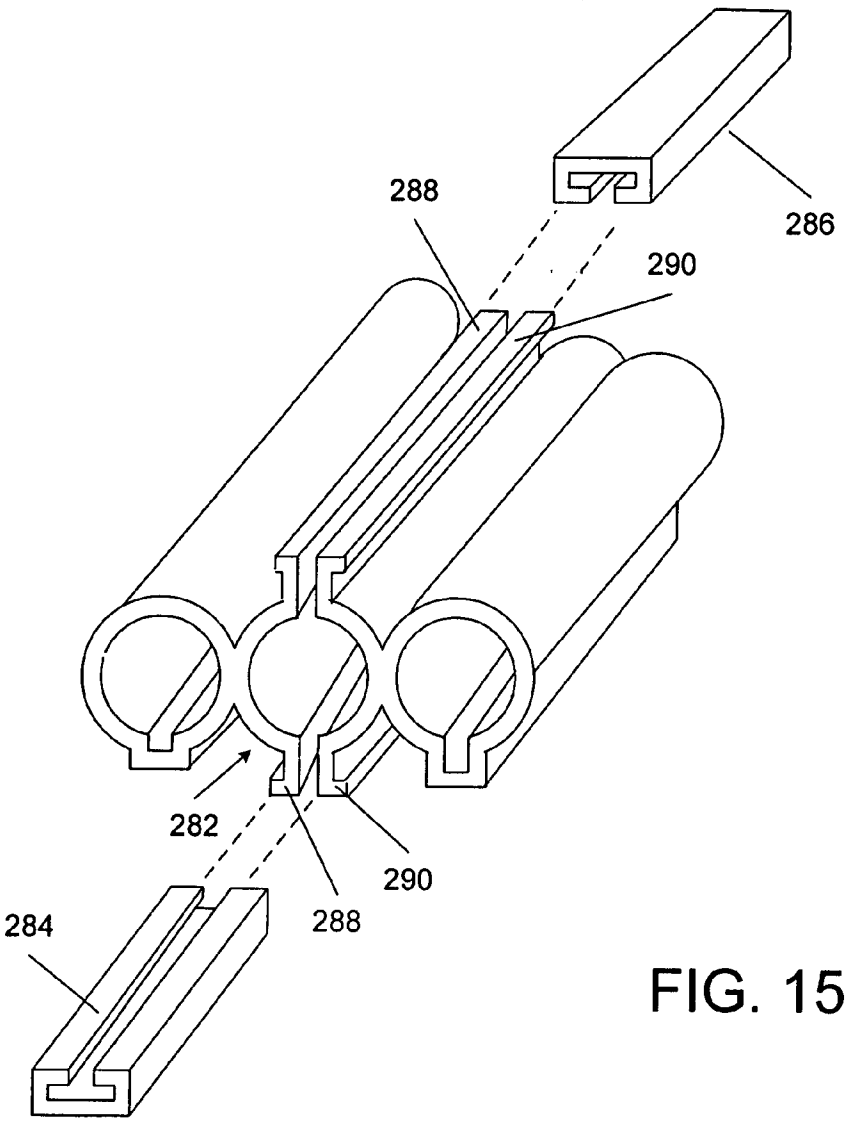
FIG. 15 shows a split, two piece antenna housing.

A still further embodiment of an antenna housing is shown in FIG. 15. The center tube 282 of the split-lead antenna housing is split in half along its length for stowage and shipment. The housing is attached to a support wire/backstay by means of two brackets 284 and 286 when engaged with flanges 288, 290 on both sides of the center tube 282. This two-part antenna housing could also be specified for the antenna couplers 256 described in reference to FIG. 12.

While a particular embodiment of the present invention has been shown and described, it will be obvious to those skilled in the art that changes and modifications may be made without departing from the spirit of the present invention, and therefore the appended claims are to include these changes and alterations as follow within the true spirit and scope of the present invention.

What is claimed is:

1. An antenna assembly comprising:

a) a first elongated radiator apparatus having a solid insulative core with a first electrically conductive element thereon having a first radiator proximal end;

b) a second elongated radiator apparatus having a solid insulative core with a second electrically conductive element thereon having a second radiator proximal end, wherein said first and second proximal ends are connected electrically; and c) a housing for holding a substantial length of said first radiator apparatus and said second radiator apparatus juxtaposed and laterally spaced apart, and said housing configured for mounting on a conductive backstay wherein said backstay is positioned substantially parallel to and equidistance from said first and second radiator apparatus.

2. An antenna assembly comprising:

a) a first elongated radiator apparatus having an electrical conductor having a proximal end;

b) a second elongated radiator apparatus having an electrical conductor having a proximal end electrically connected to said proximal end of said first conductor; and c) a housing for holding a substantial length of said first and said second conductors spaced apart and juxtaposed, and for holding said first and second conductors substantially equi-distance from the conductive backstay, wherein said housing includes a center tube apparatus having a slot for forcing a backstay there through, and apparatus for tensioning said center tube on said backstay, wherein said apparatus for tensioning includes an interlocking groove to channel flange apparatus integrally formed on said center tube.

3. An antenna assembly comprising:

a) a first elongated radiator apparatus having an electrical conductor having a proximal end;

b) a second elongated radiator apparatus having an electrical conductor having a proximal end electrically connected to said proximal end of said first conductor; and c) a housing for holding a substantial length of said first and said second conductors spaced apart and juxtaposed, and for holding said first and second conductors substantially equi-distance from the conductive backstay, wherein said housing includes a center tube apparatus having a slot for forcing a backstay there through, and apparatus for tensioning said center tube on said backstay, wherein said apparatus for tensioning includes i) flanges protruding from each of two sides of said slot; and ii) a channeled clamp apparatus for forcibly fitting over said flanges to tension said center tube onto a backstay.

4. An assembly as recited in claim 1 wherein said housing includes:

a) a plurality of separate sections, wherein each said section includes means for supporting a length of said radiator apparatus; and b) apparatus for interconnecting said sections together.

5. An assembly as recited in claim 1 further comprising clamp apparatus for clamping on a backstay and for clamping said housing to said backstay.

6. An assembly as recited in claim 5 wherein said clamp apparatus includes a standoff for restricting movement of an end of said housing so as to provide clearance for exit of said conductors from said housing.

7. An assembly as recited in claim 1 wherein said proximal ends are connected at a junction for connecting to a lead-in wire.

* * * * *